US006584618B1

(12) United States Patent
Mirharooni

(10) Patent No.: US 6,584,618 B1
(45) Date of Patent: Jul. 1, 2003

(54) PERSONALIZED TIE

(76) Inventor: Eddia Mirharooni, 238 N. Canon Dr., Beverly Hills, CA (US) 90210

( * ) Notice: Subject to any disclaimer, the term of this patent is extended or adjusted under 35 U.S.C. 154(b) by 0 days.

(21) Appl. No.: 10/055,698

(22) Filed: Jan. 25, 2002

(51) Int. Cl.[7] ..... A41D 25/00
(52) U.S. Cl. ..... 2/144; 2/145
(58) Field of Search ..... 2/144, 145, 146, 2/147, 155, 156, 157

(56) References Cited

U.S. PATENT DOCUMENTS 1,927,584 A * 9/1933 Fallar ..... 40/672
2,148,154 A * 2/1939 Garfinkle ..... 2/146
5,073,987 A * 12/1991 Crosier ..... 2/144
5,651,677 A * 7/1997 Hildebrandt ..... 2/145
5,745,918 A * 5/1998 Shukla et al. ..... 2/144
6,266,823 B1 * 7/2001 Padoan ..... 2/144

* cited by examiner

*Primary Examiner*—Gary L Welch

(57) ABSTRACT

A necktie to be worn around the neck of a wearer is constructed from an elongated piece of cloth material having a front surface, a back surface and two side edges defining a width of the necktie. An overlapping pleat formed on the front surface of the necktie and extending between the two side edges defines a location for the insertion of an adhesive blank label therein for allowing a wearer to personalized the necktie with a custom recordation.

2 Claims, 1 Drawing Sheet

PERSONALIZED TIE

FIELD OF THE INVENTION

This invention relates to neckties, worn by men, having an adhesive label enclosed by an overlapping pleat on the front surface of the necktie.

DESCRIPTION OF PRIOR ART

Various manufacturers of clothing for men create an item commonly known as a necktie, comprising a length of cloth material worn around the neck and tied in front. Neckties serve as both a decorative article of clothing and a functional one, covering the shirt.

Although neckties are created in various types and designs of material, they do not provide an area on the front on which the owner can individualize the tie. If the owner attempts to write or otherwise record information on the necktie such as a name, the recordation will typically damage the material as well as expose the recordation to the public view. Also, the beauty of the necktie may be compromised by such recordation.

BRIEF SUMMARY OF THE INVENTION

In accordance with the present invention, the inventor has invented a new and useful necktie for enabling a wearer to personalize the front surface of the necktie with a recordation, such as initializing, writing a memo, writing a signature or some other written notation, without damaging the material of the necktie or distracting from the beauty of the necktie.

In accordance with the present application, the inventor has discovered a new and useful method in manufacturing neckties for enabling a wearer to personalize the front surface of the necktie without damaging the material of the necktie or distracting from the beauty of the necktie.

DETAILED DESCRIPTION OF THE INVENTION

Figure 1:
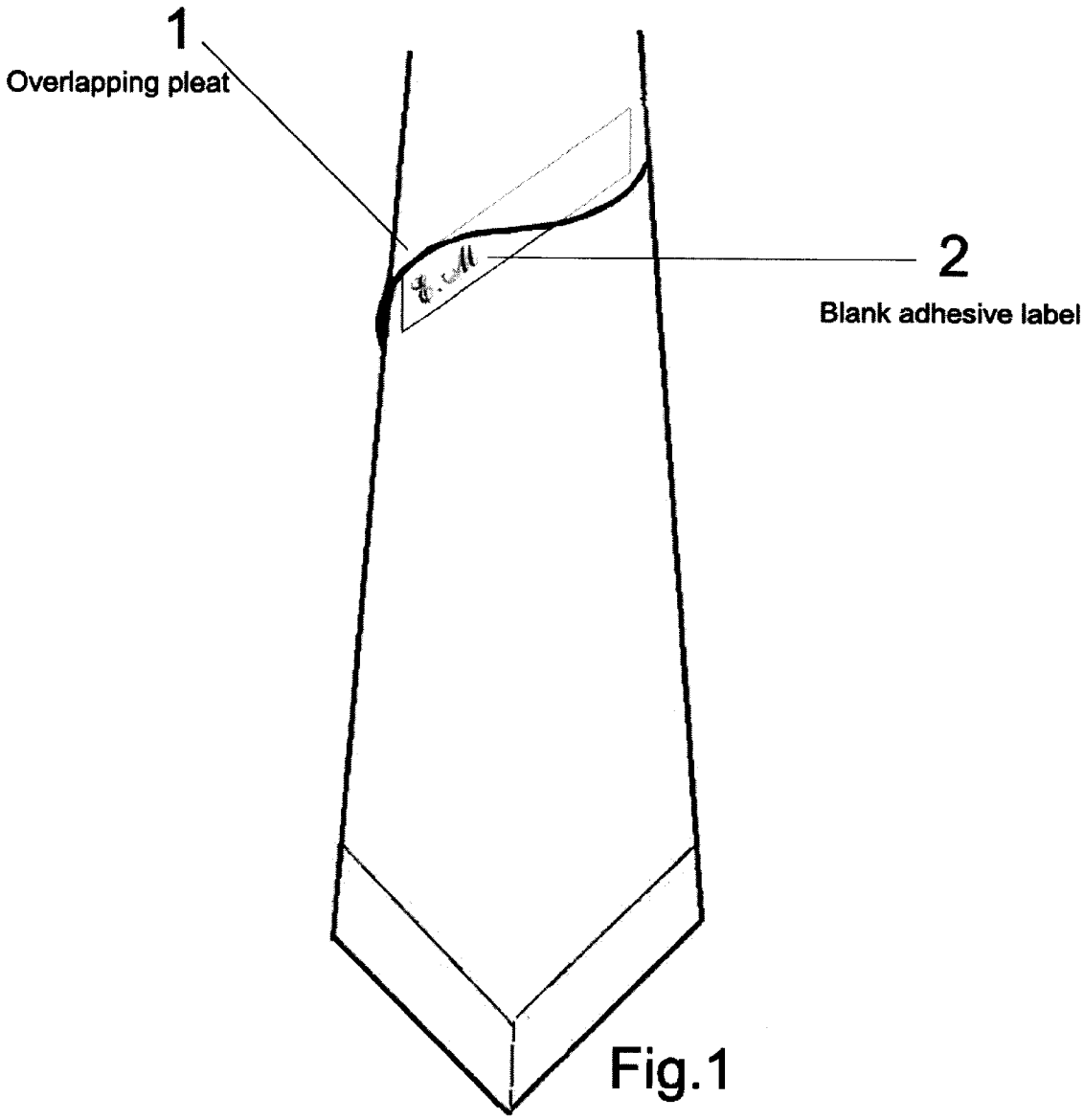
FIG. 1 is a front view of the personalized border tie illustrating an overlapping pleat and a blank adhesive label.

The preferred embodiment of the invention provides a necktie made from an elongated piece of cloth or other material such as silk. The necktie has a first and second edge that defines the width of the necktie, a front surface that faces away from the wearer and a back surface that faces the wearer. The configuration of the necktie enables the necktie to be knotted and tied around the neck of the wearer. The necktie has an overlapping pleat 1 formed on the front surface of the necktie and extending between the first and second edges for defining a location for the attachment of a blank adhesive label 2 thereto. The label 2 is removably affixed underneath the overlapping pleat 1. The label 2 permits an individual to personalize the necktie such as by initializing, writing a memo or a signature or for any other purpose the wearer desires. The overlapping pleat 1 is sized and provided anywhere along the front surface of the necktie that would not be affected by the knotting or tying of the necktie around the wearer's neck. The label 2 is subsequently ironed onto the necktie.

In another preferred embodiment of the invention, the location where the label 2 is affixed to may have an adhesive applied thereto wherein a blank label 2 may be affixed underneath the overlapping pleat 1 by ironing.

In another preferred embodiment of the invention, the overlapping pleat 1 may be stitched (not shown) to the front surface of the necktie.

The personalized necktie is constructed from an elongated piece of cloth or other material such as silk and sized of a length for ensuring the necktie is of an appropriate length when worn about the neck of the wearer. An overlapping pleat 1 is formed in the front surface of the necktie by folding the front surface of the necktie about itself at a predetermined location along the front surface of the necktie that will not be affected by the knotting of the necktie about the wearer's neck. The folding and sizing of the front surface of the necktie creates an overlapping pleat wherein a location is formed therein for accepting an adhesive label. The wearer personalizes the blank adhesive label 2 with any recordation the wearer chooses and inserts and affixes the adhesive label 2 at the location formed by the overlapping pleat 1 by ironing. Additionally, the overlapping pleat 1 may be stitched (not shown) with stitching thereby enclosing the label 2 within the overlapping pleat 1.

The overlapping pleat 1 acts as an element of the neckties beauty, and also allows the owner to cover or enclose an item the owner chooses to attach to the necktie as described above, concealing it from public view and protecting it from accidental removal.

Although the descriptions above contain specific details concerning the functions and purposes of the necktie, the descriptions should not be construed as limiting the scope of functions or purposes of the necktie, but merely as an illustration of a preferred role of the necktie. The scope of the invention should be determined by the appended claims and their legal equivalents, rather than by the examples set forth above.

What is claimed is:

1. A necktie worn around a neck of a wearer comprising:

a length of cloth material having first and second edges defining the width of the necktie, a front surface facing away from the wearer and a back surface facing the front of the wearer whereby the length of cloth material is configured to be tied into a knot about the neck of the wearer;

an overlapping pleat formed on the front surface of the necktie and extending between said first and second edges for defining a location for the attachment of an adhesive label underneath thereof, and;

an adhesive label removably affixed to said location for enabling a wearer to individualize the necktie and wherein the label is positioned underneath the overlapping pleat.

2. A method of manufacturing a necktie worn about a neck of a wearer comprising, providing a length of cloth material having first and second edges defining the width of the necktie, a front surface that faces away from the wearer and a back surface opposite to the front surface whereby the length of cloth material is configured to be tied into a knot about the neck of the wearer;

providing an adhesive blank label;

placing said existing necktie on a flat surface;

folding a section of said front surface such that said folded area forms an overlapped pleat.

* * * * *